US010465519B2

(12) United States Patent
Bouchard et al.

(10) Patent No.: US 10,465,519 B2
(45) Date of Patent: Nov. 5, 2019

(54) FASTENING SYSTEM FOR ROTOR HUBS

(71) Applicant: PRATT & WHITNEY CANADA CORP., Longueuil (CA)

(72) Inventors: Guy Bouchard, Mont St-Hilaire (CA); Eugene Gekht, Brossard (CA); Danny Mills, Chateauguay (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 1256 days.

(21) Appl. No.: 14/056,488

(22) Filed: Oct. 17, 2013

(65) Prior Publication Data

US 2015/0110628 A1 Apr. 23, 2015

(51) Int. Cl.

| | |
|---|---|
| ***F01D 5/06*** | (2006.01) |
| *F01D 25/24* | (2006.01) |
| *F04D 29/32* | (2006.01) |
| *F01D 5/02* | (2006.01) |
| *F01D 11/00* | (2006.01) |

(52) U.S. Cl.

CPC ..... *F01D 5/066* (2013.01); *F01D 5/025* (2013.01); *F01D 5/06* (2013.01); *F01D 11/001* (2013.01); *F01D 25/243* (2013.01); *F04D 29/321* (2013.01); *F05D 2230/60* (2013.01); *F05D 2260/30* (2013.01); *F05D 2260/31* (2013.01); *Y10T 29/49948* (2015.01); *Y10T 29/49963* (2015.01)

(58) Field of Classification Search

CPC ..... F01D 5/066; F01D 5/06; F01D 11/001; F04D 29/20; F16B 5/0275; F16B 39/282

USPC ..... 411/389, 166

See application file for complete search history.

(56) References Cited

U.S. PATENT DOCUMENTS 4,743,138 A 5/1988 Goy
4,844,694 A * 7/1989 Naudet ..... F01D 5/066 415/199.5

(Continued)

FOREIGN PATENT DOCUMENTS

EP 3051062 A1 * 8/2016 ..... F01D 5/06

*Primary Examiner* — Carlos A Rivera
*Assistant Examiner* — Behnoush Haghighian
(74) *Attorney, Agent, or Firm* — Norton Rose Fulbright Canada LLP

(57) ABSTRACT

A rotor disk assembly comprises a first rotor disk with a plurality of circumferentially distributed first throughbores. A second rotor disk comprises a connection portion projecting at least partially axially, a plurality of circumferentially distributed second throughbores being provided in the connection portion in cooperative distribution relative to the first rotor disk for the first and second throughbores to be in register with one another in the rotor disk assembly. Connector bolts each have an elongated body with a flange between its ends, a head at its first end and a removable head at its second end, the head at the first end spaced apart from the flange for the connector bolt to be secured to one of the rotor disks at a respective throughbore, the removable head at the second end being spaced apart from the flange for the second end to project. An anti-rotation feature is between each said connector bolt and at least one of the rotor disks to prevent rotation of the connector bolts when the removable head is installed on the second end in the rotor disk assembly.

14 Claims, 4 Drawing Sheets

(56) References Cited

U.S. PATENT DOCUMENTS

| | | | | |
|---|---|---|---|---|
| 5,052,891 | A * | 10/1991 | Burkholder | F01D 5/066 29/525 |
| 5,660,526 | A * | 8/1997 | Ress, Jr. | F01D 5/02 416/198 A |
| 5,779,416 | A | 7/1998 | Sternitzky | |
| 6,267,553 | B1 * | 7/2001 | Burge | F01D 5/06 415/115 |
| 6,428,272 | B1 | 8/2002 | Pepi et al. | |
| 6,471,474 | B1 * | 10/2002 | Mielke | F01D 5/02 29/889.21 |
| 6,499,957 | B1 * | 12/2002 | Klingels | F01D 5/066 416/198 A |
| 6,887,043 | B2 * | 5/2005 | Dix | F01D 5/066 416/244 A |
| 8,100,666 | B2 * | 1/2012 | Makuszewski | F01D 5/066 29/889.1 |
| 8,221,062 | B2 * | 7/2012 | Liotta | F01D 5/066 415/173.7 |
| 8,517,687 | B2 * | 8/2013 | Benjamin | F01D 5/066 416/198 A |
| 9,200,520 | B2 * | 12/2015 | Lecuyer | F01D 5/066 |
| 2015/0322794 | A1 * | 11/2015 | Douady | F01D 5/027 416/144 |

* cited by examiner

FASTENING SYSTEM FOR ROTOR HUBS

TECHNICAL FIELD

The present application relates to fastening systems for fastening rotor disks to a shaft, for instance in gas turbine engines.

BACKGROUND OF THE ART

In gas turbine engines, the assembly of rotor components to a shaft is constrained by the limited space. For instance, it may be desired to have compact rotors, but this compactness causes difficulties in the assembly of the rotor components on a shaft. Typically, in order to interconnect rotor disks, the rotor disks are axially positioned end to end, with bolts then installed to interconnect rotor disks. Accordingly, there must be sufficient clearance to allow the installation of the bolts, which bolts are typically elongated. This may have an impact on the compactness of the rotor.

SUMMARY

Therefore, in accordance with the present disclosure, there is provided a rotor disk assembly comprising: a first rotor disk with a plurality of circumferentially distributed first throughbores; a second rotor disk comprising a connection portion projecting at least partially axially, a plurality of circumferentially distributed second throughbores being provided in the connection portion in cooperative distribution relative to the first rotor disk for the first and second throughbores to be in register with one another in the rotor disk assembly; connector bolts, each said connector bolt having an elongated body with a flange between its ends, a head at its first end and a removable head at its second end, the head at the first end spaced apart from the flange for the connector bolt to be secured to one of the rotor disks at a respective throughbore, the removable head at the second end being spaced apart from the flange for the second end to project ; and an anti-rotation feature between each said connector bolt and at least one of the rotor disks to prevent rotation of the connector bolts when the removable head is installed on the second end in the rotor disk assembly.

Further in accordance with the present disclosure, there is provided A method for fastening rotor disks to a shaft, comprising: fastening connector bolts to one of a first and a second rotor disk; positioning and securing the first rotor disk to the shaft; axially moving the second rotor disk onto the shaft until the connector bolts fastened to one of the rotor disks penetrate throughbores in the other one of the rotor disks; and fastening the connector bolts to the assembly of the rotor disks.

DETAILED DESCRIPTION

Figure 1:
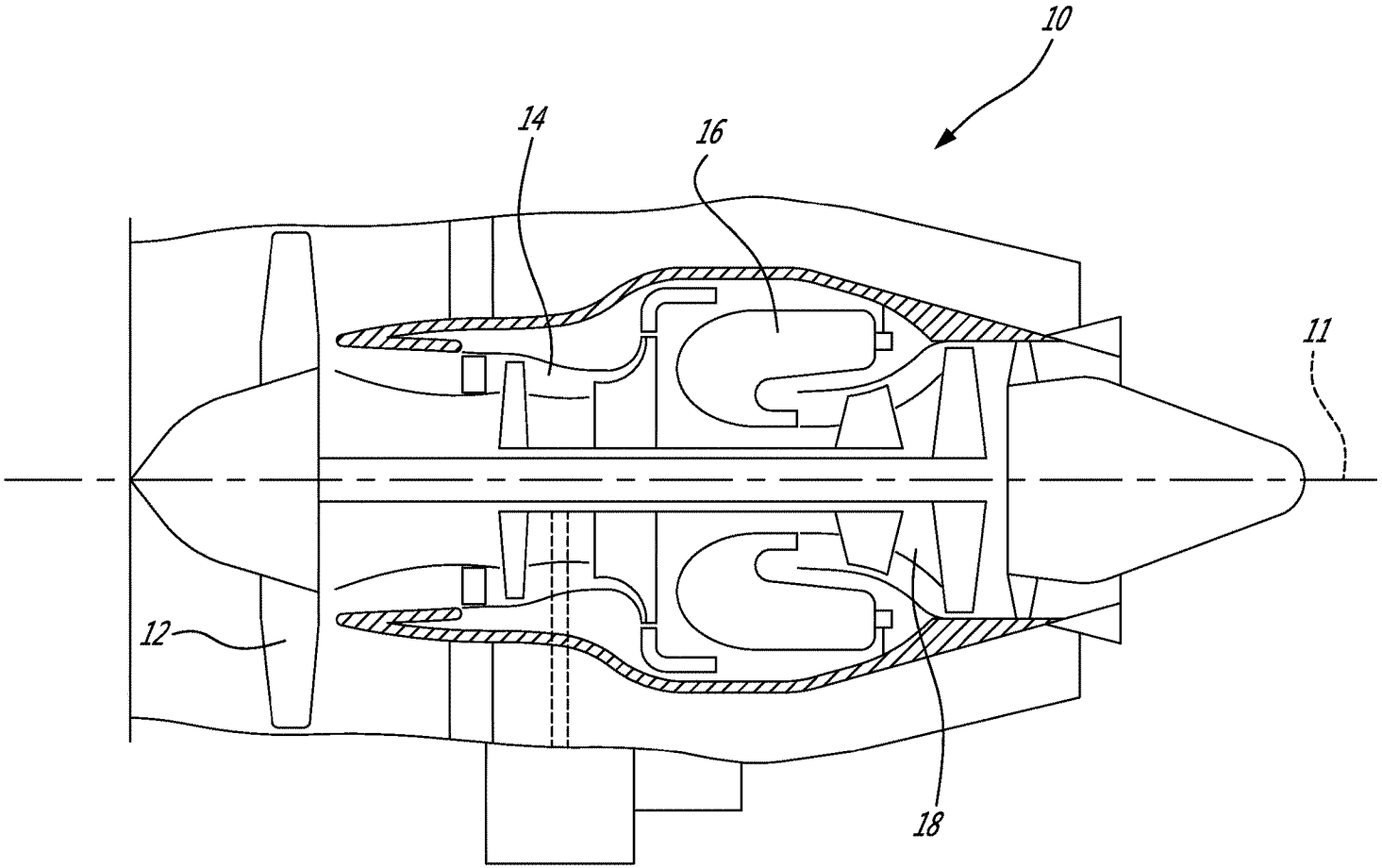
FIG. 1 is a schematic cross-sectional view of a turbo-fan gas turbine engine.

FIG. 1 illustrates a turbo-fan gas turbine engine 10 of a type preferably provided for use in subsonic flight, generally comprising in serial flow communication a fan 12 through which ambient air is provided, a multi-stage compressor 14 for pressurizing the air, a combustor 16 in which the compressed air is mixed with fuel ignited for generating an annular stream of hot combustion gases, and a turbine section 18 for extracting energy from the combustion gases.

Figure 2:
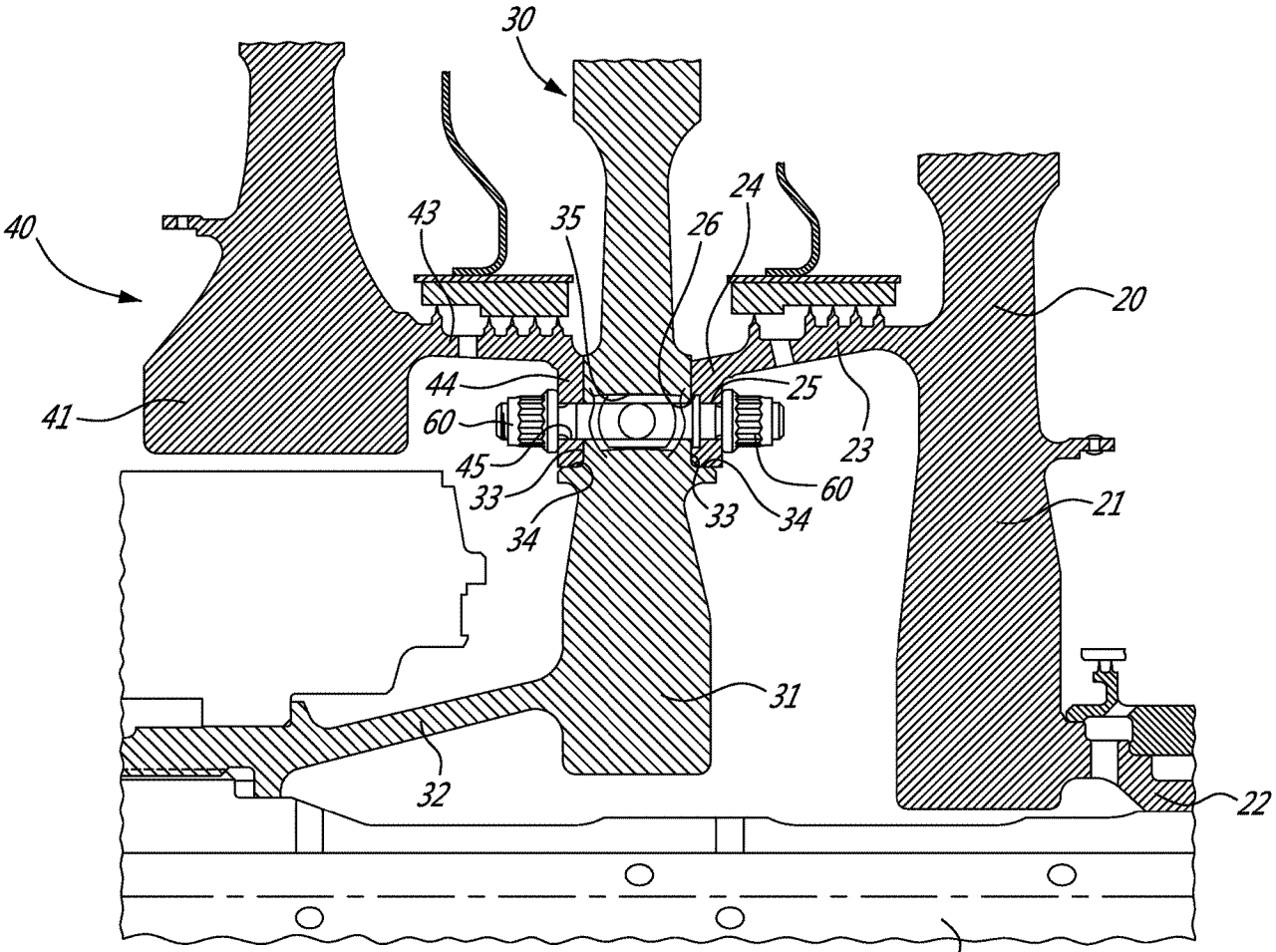
FIG. 2 is a schematic enlarged view of rotor disks interconnected with a fastening system of the present disclosure.

Referring to FIG. 2, there is shown an enlarged view of the turbine section 18 showing three rotor disks, mainly rotor disks 20, 30 and 40 (a.k.a., rotor hubs), interconnected by the fastening system of the present disclosure. Although the three rotor disks 20, 30 and 40 are shown as being interconnected, it is contemplated to use the fastening system of the present disclosure to interconnect two rotor disks as well. Moreover, while FIG. 2 shows rotor disks of the turbine section 18, it is considered to use the fastening system in other sections such as the compression section.

The rotor disk 20 is the downstream-most one of the interconnected rotor disks shown in FIG. 2. The rotor disk 20 has a web 21 at a radial periphery of which are connected numerous rotor blades (not shown), the web 21 being in the form of a disk, whereby the rotor disk may be referred to as a rotor disk as well. The rotor disk 20 is rotatively coupled to shaft A by way of a coupling shaft 22 (a.k.a, the bore). Although not shown, an appropriate connector are provided for the coupling shaft 22 of the rotor disk 20 to be rotatively secured to the shaft A. A connection rim 23 projects in a generally axial direction toward the rotor disk 30 and may have sealing features thereon as shown. A flange 24 is at a free end of the connection rim 23. The flange 24 generally lies in a radial plane relative to the longitudinal axis of the shaft A in the illustrated embodiment, although other orientations are possible for the flange 24. Throughbores 25 are circumferentially distributed along the flange 24. An annular channel 26 is provided in communication with the through bore 25 and faces toward the rotor disk 30. The annular channel 26 may therefore be concentrically positioned within the flange 24. Hence, although the sectional view of FIG. 2 shows a single one of the throughbores 25 within the annular channel 26, there are numerous of these throughbores 25 in the channel 26 along the rotor disk 20. The flange 24 may alternatively be a series of tabs, with counterbores instead of the annular channel 26.

Still referring to FIG. 2, the rotor disk 30 is positioned upstream of the rotor disk 20. The rotor disk 30 has a disk-shaped web 31 and a coupling shaft 32 (a.k.a., a bore) projecting in an axially upstream direction, by which the rotor disk 30 is coupled to the shaft A. An interconnection between the rotor disk 30 and the turbine shaft A will be described hereinafter. The web 31 has at least one annular surface 33 facing toward the rotor disk 20. The web 31 may have a pair of the annular surfaces 33, as in FIG. 2, with the other of the annular surfaces 33 facing toward the rotor disk 40. Moreover, in the illustrated embodiment, the annular surfaces 33 are parallel to one another, and lie in parallel planes to which the longitudinal axis of shaft A is normal. Radial abutments 34 may bound the annular surfaces 33, inwardly. Throughbores 35 are circumferentially distributed in the web 31. The throughbores 35 are spaced apart by the same distance as are the throughbores 25 in the rotor disk 20, for sets of throughbores 25 and 35 to be in register when the rotor disks 20 and 30 are interconnected.

Still referring to FIG. 2, the rotor disk 40 is also shown having a web 41 with rotor blades (not shown) being connected to a radial end of the web 41. As illustrated, the rotor disk 40 is not connected directly to the shaft A, but is instead connected to the rotor disk 30. A connection rim 43 projects in a generally axial direction from the web 41, toward the rotor disk 30. The connection rim 43 may have sealing features as shown in FIG. 2. A flange 44 is provided at an end of the connection rim 43. The flange 44 is shown as being oriented radially inward, although other configurations are considered as well. Moreover, the flange 44 is shown as lying in a radial plane relative to the longitudinal axis of the shaft A, although other orientations are possible as well. Throughbores 45 are circumferentially distributed along the flange 44. Throughbores 45 are spaced apart the same distance as the throughbores 35 of the rotor disk 30 and hence, of the through bores 25 of the rotor disk 20, for sets of throughbores 25, 35 and 45 to be in register when the rotor disks 20, 30 and 40 are interconnected. The throughbores 25, 35 and 45 are thus in a cooperative distribution. Likewise, there may be alternate configurations to the flange 44, such as a plurality of projecting tabs.

Figure 3:
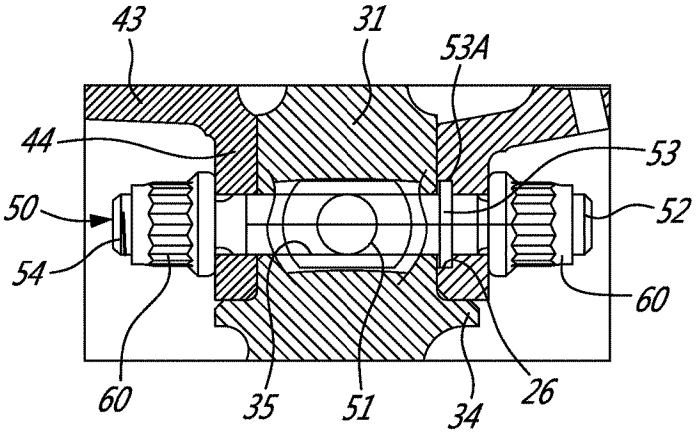
FIG. 3 is an enlarged view showing the fastening system of the present disclosure as interconnecting the rotor disks.

Referring to FIGS. 2 and 3, the rotor disks 20, 30 and 40 are interconnected by a fastening system of the present disclosure. The fastening system comprises a plurality of connector bolts 50 and heads 60 (i.e., nuts 60). FIGS. 2 and 3 show one such connector bolt 50 with a pair of the heads 60. The connector bolt 50 is made of a metallic material and has an elongated body 51. The elongated body 51 has a threaded end 52 and, in close proximity thereto, a flange 53. The flange 53 has at least one abutment surface 53A in its circumferential surface. In an embodiment, the flange 53 has two flat surfaces acting as abutment surfaces 53A, the two flat surfaces disrupting the otherwise cylindrical shape of the flange 53. The flange 53 may be integrally connected, monolithically connected, and/or permanently secured to the elongated body 51. Alternatively, the connector bolt 50 may have a bolt head instead of a threaded end and nut, and the flange 53 could be a removable lock ring (also forming a flange when installed), provided the removable lock ring has sufficient structural integrity.

The opposite end of the elongated body 51 is threaded end 54. When the connector bolt 50 is used to interconnect the rotor disk 20 to the rotor disk 30, throughbores 25 and 35 of the rotor disks 20 and 30, respectively, are aligned with the elongated body 51 passing therethrough, and with the flange 53 being received in the annular channel 26 of the rotor disk 20. The thickness of the flange 53 is such that a surface of flange 24 is coplanar with the annular surface 33. Moreover, the cooperation between the periphery of the annular channel 26 and the abutment surfaces 53A of the flange 53 prevents free rotation of the connector bolt 50 in the arrangement of FIGS. 2 and 3, i.e., an anti-rotation feature.

Figure 4:
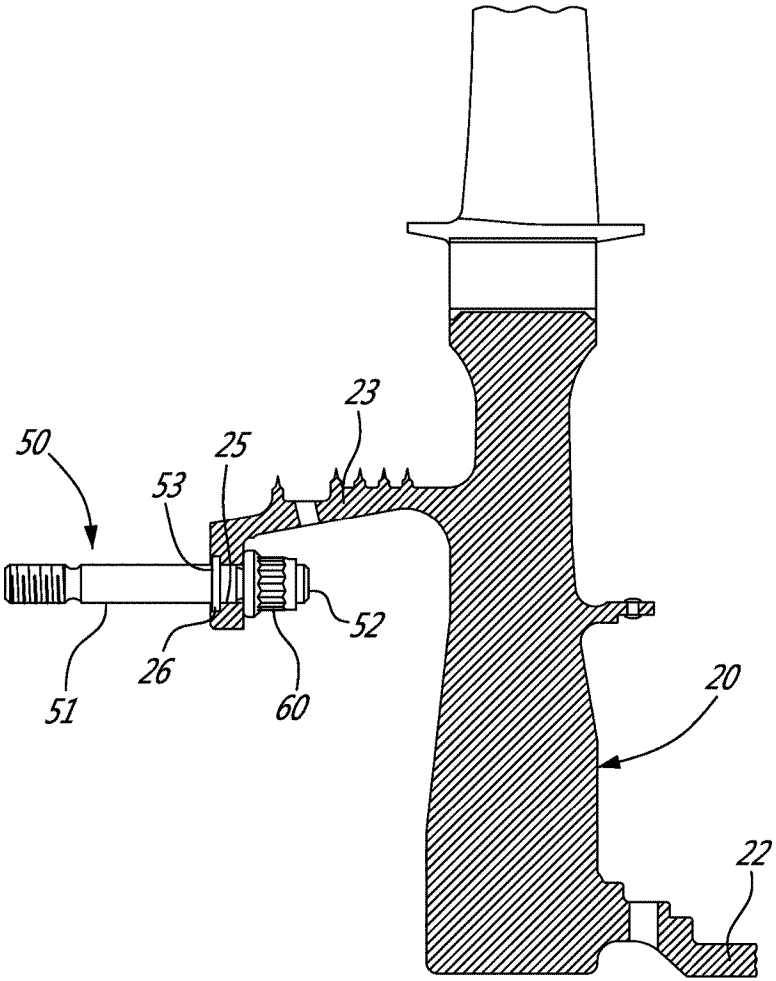
FIG. 4 is a schematic view of part of the fastening system as pre-installed on one of the rotor disks.

One of the heads 60 is a nut threadingly engaged to the threaded end 52 of the connector bolt 50, whereby the connector bolt 50 is secured to the rotor disk 20. This is shown in FIG. 4, which shows a pre-assembled configuration that is typically done prior to the installation of the rotor disk 20 onto the shaft A. Due to the anti-rotation feature, the nut 60 may be engaged and tightened to the connector bolt 50 by attending to only a single end of the connector bolt 50.

The elongated body 51 of the connector bolt 50 is sized in such a way that the threaded end 54 projects outwardly of the annular surface 33 of the web 31. Accordingly, another head (also a nut 60) may be used to secure the connector bolt 50 and hence, the rotor disk 30, to the rotor disk 20. The elongated body 51 of the connector bolt 50 may vary in length, in accordance with the number of rotor disks interconnected (e.g., two or three), and the thickness of the components.

Although the fastening system is described as being connected to the rotor disk 20 first, it is pointed out that the connector bolt 50 and anti-rotation feature (i.e., flange 53) could be connected to the rotor disk 30 first, especially when no third rotor disk is part of the rotor disk assembly. For example, the annular channel 26 could be in the rotor disk 30.

It is also possible to add the rotor disk 40 to this assembly in the manner shown in FIG. 2. More specifically, the threaded end 54 is spaced apart from the annular surface 33 in such a way that the flange 44 may be abutted against the annular surface 33, with the threaded end 54 projecting axially beyond the flange 44, in the shown assembly. Due to the anti-rotation feature, nuts 60 may be tightened without having to retain the connector bolt 50 from rotating during the tightening.

It is observed that the annular surfaces 33 with radial abutments 34 of the rotor disk 30 are shaped and dimensioned to offer additional contact surface for the flanges 24 and 44, respectively, of rotor disks 20 and 40. The additional contact surface therebetween adds to the structural integrity of coupling assembly.

In order to assemble the rotor disks 20, 30 and 40 if applicable, the connector bolts 50 are connected to the rotor disk 20 in the manner shown in FIG. 4. This involves the use of one of the nuts 60.

As described above, the flange 53 of the connector bolt 50 is accommodated in the annular channel 26 of the rotor disk 20. The attachment of the connector bolts 50 to the rotor disk 20 may be done prior to the installation of the rotor disk 20 on the turbine shaft A. Alternatively, the connector bolt 50 could be secured to the rotor disk 30 instead of the rotor disk 20.

Figure 5:
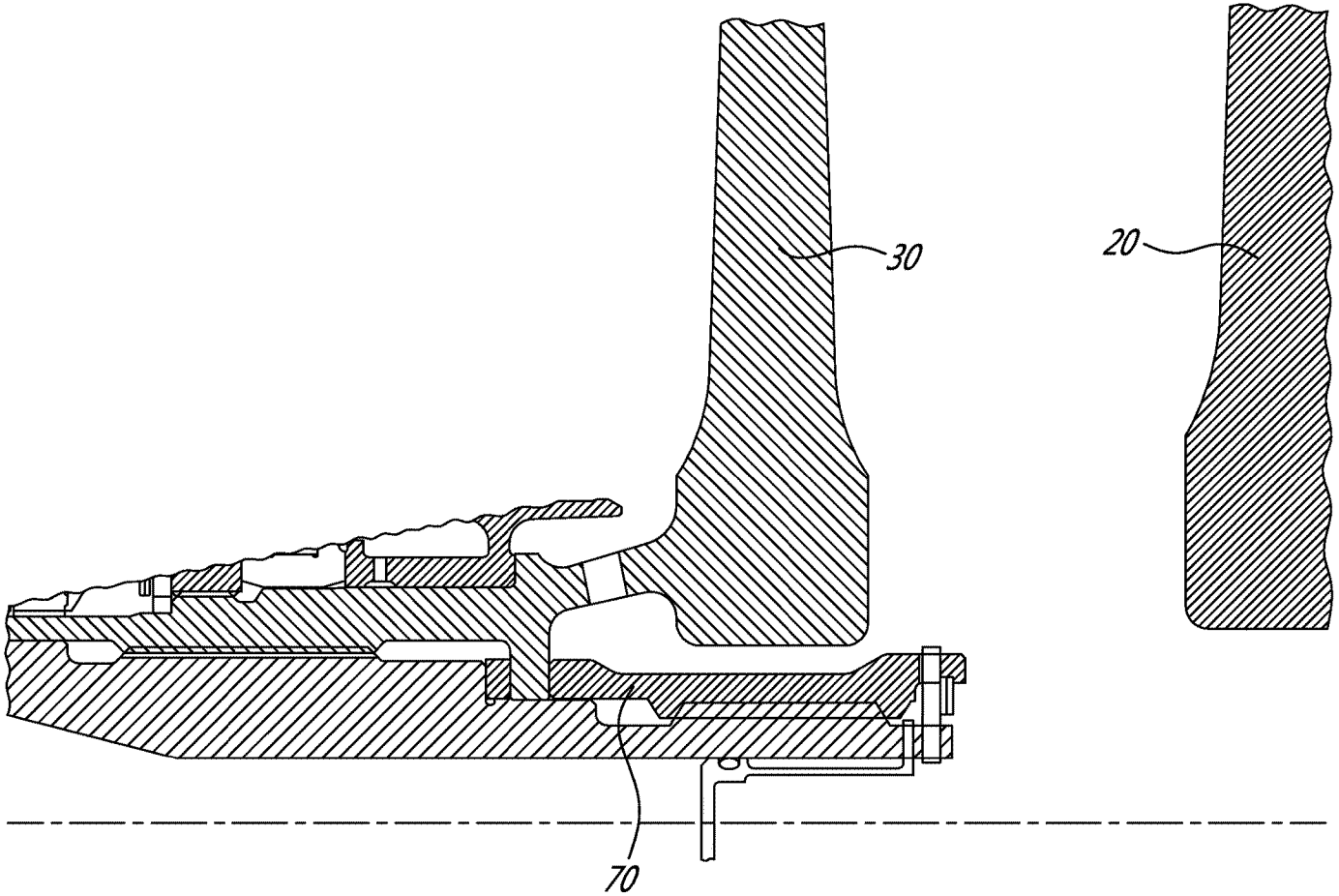
FIG. 5 is an enlarged view showing a lock nut of the fastening system as securing a rotor disk to a shaft.

The rotor disk 30 is firstly installed onto the shaft A. Referring to FIG. 5, a lock nut 70 may be used to press the rotor disk 30 against an abutment of the shaft A. The lock nut 70 presses on the coupling shaft 32 in the matter shown in FIG. 5, whereby the rotor disk 30 is secured to the shaft A.

The rotor disk 30 may then be assembled to the rotor disk 20 by axially moving the rotor disk 30 into engagement with the rotor disk 20, such that the connector bolts 50 pre-installed on the rotor disk 20 (or rotor disk 30) penetrate the throughbores 35 of the rotor disk 30 (or throughbores 25 of the rotor disk 20). It is pointed out that this arrangement does not require high preloads to keep these rotors 20 and 30 together, unlike convention fastening systems with dogs and slots requiring appropriate tension between rotors to keep them connected.

If there is no additional rotor disk to be connected to the assembly (e.g., such as the rotor disk 40), the nuts 60 may be screwed onto the threaded ends 54 projecting axially out of the rotor disk 30 (or threaded ends 52 projecting out of the rotor disk 20). It is observed that, due to the anti-rotation feature, the tightening of the nuts 60 may be done without having to hold both ends of the connector bolt 50.

If the rotor disk 40 is also to be connected to the assembly in the manner shown in FIG. 2, the rotor disk 40 is axially moved into engagement with the rotor disk 30, prior to the nuts 60 being screwed onto the threaded end 54. As a result, the threaded ends 54 of the connector bolts 50 project axially out of the flange 44 of the rotor disk 40, in the manner shown in FIGS. 2 and 3. Thereafter, nuts 60 may be threaded onto the threaded end 54 to secure the rotor disk 40 to the rotor disks 20 and 30, again with the benefit of the anti-rotation feature.

The above description is meant to be exemplary only, and one skilled in the art will recognize that changes may be made to the embodiments described without departing from the scope of the invention disclosed. For example, the anti-rotation feature may be any other appropriate arrangement: keyway or abutment surface on the connector bolt, throughpin, locking washer, to name a few. Also, circumferentially distributed is used to describe that throughbores are spread over the circumference of the rotor disk, but includes various arrangements including a non-equidistant spacing between adjacent throughbores, the distribution of the throughbores at variable radial distances on the disk, etc. Still other modifications which fall within the scope of the present invention will be apparent to those skilled in the art, in light of a review of this disclosure, and such modifications are intended to fall within the appended claims.

The invention claimed is:

1. A rotor disk assembly comprising:

a first rotor disk with a plurality of circumferentially distributed first throughbores;

a second rotor disk comprising a connection portion projecting at least partially axially, a plurality of circumferentially distributed second throughbores being provided in the connection portion in cooperative distribution relative to the first rotor disk for the first and second throughbores to be in register with one another in the rotor disk assembly; and connector bolts, each said connector bolt having an elongated body with a flange between its ends, a first removable head at its first end and a second removable head at its second end, the first removable head at the first end spaced apart from the flange for the connector bolt to be secured to one of the rotor disks at a respective throughbore, the second removable head at the second end being spaced apart from the flange;

an anti-rotation feature defined by an engagement between each said connector bolt at the flange and the at least one of the rotor disks to prevent rotation of the connector bolts when the second removable head is installed on the second end in the rotor disk assembly.

2. The rotor disk assembly according to claim 1, wherein the connection portion comprises a connection rim and a connection flange at a free end thereof, the plurality of circumferentially distributed second throughbores being in the connection flange.

3. The rotor disk assembly according to claim 2, wherein a side of the connection flange that faces toward the first rotor disk lies in a radial plane relative to a rotational axis of the rotor disk assembly.

4. The rotor disk assembly according to claim 2, further comprising an annular surface in the first rotor disk, with the plurality of circumferentially distributed second throughbores opening to the annular surface, the connection flange being coplanar with the annular surface in the rotor disk assembly.

5. The rotor disk assembly according to claim 4, further comprising a radial abutment adjacent to the annular surface in the first rotor disk for abutment with an edge of the connection flange in the rotor disk assembly.

6. The rotor disk assembly according to claim 1, wherein the anti-rotation feature is defined by an engagement between an annular channel in the connection portion of the second rotor disk and at least one complementary abutment surface on the flange.

7. The rotor disk assembly according to claim 1, wherein the flange is integral with the elongated body, the first end and the second end have threading and the heads are nuts.

8. The rotor disk assembly according to claim 1, further comprising a third rotor disk comprising a connection rim projecting at least partially axially and a connection flange at an end of the connection rim, a plurality of circumferentially distributed third throughbores being provided in the connection flange in a cooperative distribution as the first and the second throughbores to be in register in the rotor disk assembly.

9. The rotor disk assembly according to claim 1, further comprising a lock nut adapted to secure the first rotor disk to a shaft.

10. A method for fastening a first, a second, and a third rotor disks to a shaft, comprising:

fastening connector bolts to the second rotor disk while preventing rotation of the connector bolts via an anti-rotation feature between the connector bolts and the second rotor disk;

positioning and securing the first rotor disk to the shaft;

axially moving the second rotor disk onto the shaft until the connector bolts fastened to the second rotor disk penetrate throughbores in the first rotor disk such that a second end of the connector bolts projects beyond the first rotor disk;

axially moving the third rotor disk into contact with the first rotor disk until the fastened connector bolts penetrate throughbores in the third rotor disk; and fastening the connector bolts to an assembly including the first, the second, and the third rotor disks by installing a nut to an end of each of said connector bolts via a gap located radially between a radially inner end of the third rotor disk and the shaft.

11. The method according to claim 10, wherein securing the first rotor disk to the shaft comprises installing a lock nut axially pressing the first rotor disk against an abutment of the shaft.

12. The method according to claim 10, wherein the anti-rotation feature is an anti-rotation flange of each said connector bolt, and wherein fastening the connector bolts to the second rotor disk comprises inserting the anti-rotation flange of each said connector bolt in an annular channel of a first side of the second rotor disk, and installing a nut to a first end of the connector bolt on a second side of the second rotor disk.

13. The method according to claim 10, wherein installing a nut to an end of each said connector bolt comprises using an anti-rotation feature defined by an engagement between a flange of each of the connector bolts with the second rotor disk to prevent rotation of the connector bolts when nuts are installed thereon, The examiner's amendment above was made in order to remove 112(*b*) issues and put the application in condition for allowance.

14. The method according to claim 10, wherein fastening connector bolts to the second rotor disk is performed before installing the second rotor disk for rotation on the shaft.

* * * * *